US007008468B2

(12) United States Patent
Ashe

(10) Patent No.: US 7,008,468 B2
(45) Date of Patent: Mar. 7, 2006

(54) HEPA VACUUM RECOVERY SYSTEM

(76) Inventor: Kevin Ashe, 22250 Adams Way, Magnolia, TX (US) 77355

( * ) Notice: Subject to any disclaimer, the term of this patent is extended or adjusted under 35 U.S.C. 154(b) by 401 days.

(21) Appl. No.: 10/261,121

(22) Filed: Oct. 1, 2002

(65) Prior Publication Data

US 2004/0060147 A1 Apr. 1, 2004

(51) Int. Cl.
*B01D 29/56* (2006.01)

(52) U.S. Cl. ..... 95/286; 55/472; 55/485; 55/486

(58) Field of Classification Search ..... 55/467, 55/472, 486, 485; 95/273, 286
See application file for complete search history.

(56) References Cited

U.S. PATENT DOCUMENTS

| | | | | |
|---|---|---|---|---|
| 603,697 A | | 5/1898 | Luce | |
| 3,240,000 A | | 3/1966 | Hayes et al. | 55/337 |
| 4,938,309 A | | 7/1990 | Emdy | 181/231 |
| 4,941,230 A | | 7/1990 | Lamore | 15/314 |
| 5,230,723 A | | 7/1993 | Travis et al. | 55/350 |
| 5,240,478 A | * | 8/1993 | Messina | 95/273 |
| 5,433,763 A | | 7/1995 | Shagott et al. | 55/323 |
| 5,606,767 A | | 3/1997 | Crlenjak et al. | 15/301 |
| D394,132 S | | 5/1998 | Dixon | D32/21 |
| 5,940,926 A | | 8/1999 | Inzinna et al. | 15/301 |

* cited by examiner

*Primary Examiner*—Robert A. Hopkins
(74) *Attorney, Agent, or Firm*—Russell J. Egan

(57) ABSTRACT

A vacuum system is enclosed in a housing having two vertically spaced chambers, the lower one enclosing the vacuum generating motor means and the upper chamber defining the vacuum chamber and having therein prefilter and filter means as well as at least two vacuum ports to which vacuum wands are selectively attached, each port being sealed when not in use.

11 Claims, 4 Drawing Sheets

HEPA VACUUM RECOVERY SYSTEM

BACKGROUND OF THE INVENTION

1. The Field of the Invention

The present invention relates to an improved HEPA vacuum recovery system and, in particular, a system which is portable, has multi user capacity, and is of extremely high efficiency.

2. The Prior Art

There currently is a need for a vacuuming system: which is portable; which can provide highly efficient cleaning of dust and particulate material, particularly hazardous material such as asbestos; and which can be used simultaneously by multiple workers so that the job may be completed in a rapid and efficient manner. The are many vacuum systems available, but there is nothing available that addresses all of these needs.

U.S. Pat. Nos. 5,433,763 to Shagott et al describes a vacuum and air filtration unit which includes a plurality of separately transportable units including: a debris screening and collecting unit, an electrostatic unit, a bag filter unit, and an HEPA filter unit, and a high capacity vacuum unit. These individual units are selectively assembled in a horizontal sequence for the project at hand. However, the assembly is not suitable for simultaneous use by multiple workers and is quite bulky.

U.S. Pat. No. 5,230,723 to Travis et al also shows a plurality of separate modules, similar to those employed in the above discussed Shagott patent, which are vertically stacked into the desired configuration. While this arrangement tends to overcome some of the balkiness aspects of the Shagott device, this assembly still is not suitable for simultaneous use by multiple workers.

U.S. Pat. No. 5,490,926 to Inzinna shows a multi station vacuuming system wherein each user has individual vacuum control at their work station. However, this is a fixed system, as opposed to the portable system of the present invention and it does not come close in the amount of particulate material it will filter and trap.

U.S. Pat. No. 5,606,767 to Crienjak et al discloses another fixed system for supplying dust and debris removal from a plurality of machines. The machines are connected to a plenum which allows vacuum to be supplied only to the machine currently in operation via one or more distribution valves.

U.S. Pat. No. 4,941,230 to Lamore shows a portable system for supplying vacuum to a plurality of tacking heads, each head having an air driven brush within a housing. The brushes are preferably made from material such as ratite feathers, having the capability of rapidly generating and discharging an electrical charge.

U.S. Pat. No. 4,938,309 to Emdy relates to a "built-in" vacuum wherein the specific invention is directed toward providing acoustic damping of the noise generated by the vacuum device.

U.S. Pat. No. 3,240,000 to Hayes et al discloses a central vacuum system for domestic use. This comprises a fixed high volume vacuum source connected to a conduit system having multiple outlets. However, only one outlet at a time can be used in this system.

U.S. Pat. No. 603,697 to Luce shows a plurality of field workers each provided with a wrist-mounted funnel. The funnels are attached to collection lines leading to an exhaust fan which is used to draw cotton balls inserted into the funnels by the workers to a central collection point.

It is therefor an object of the present invention to overcome the deficiencies of the prior art and provide a highly efficient, portable vacuuming system which can be used by multiple workers simultaneously.

SUMMARY OF THE INVENTION

The present invention is enclosed in a housing provided with casters to provide portability. The housing defines two vertically spaced chambers, the lower one enclosing the vacuum generating motor means and the upper chamber defining the vacuum chamber and having therein prefilter and filter means as well as at least two vacuum ports to which vacuum wands are selectively attached, each port being sealed when not in use.

BRIEF DESCRIPTION OF THE DRAWINGS

The present invention will now be described, by way of example, with reference to the accompanying drawings in which.

DETAILED DESCRIPTION OF AN EMBODIMENT

Figure 1:
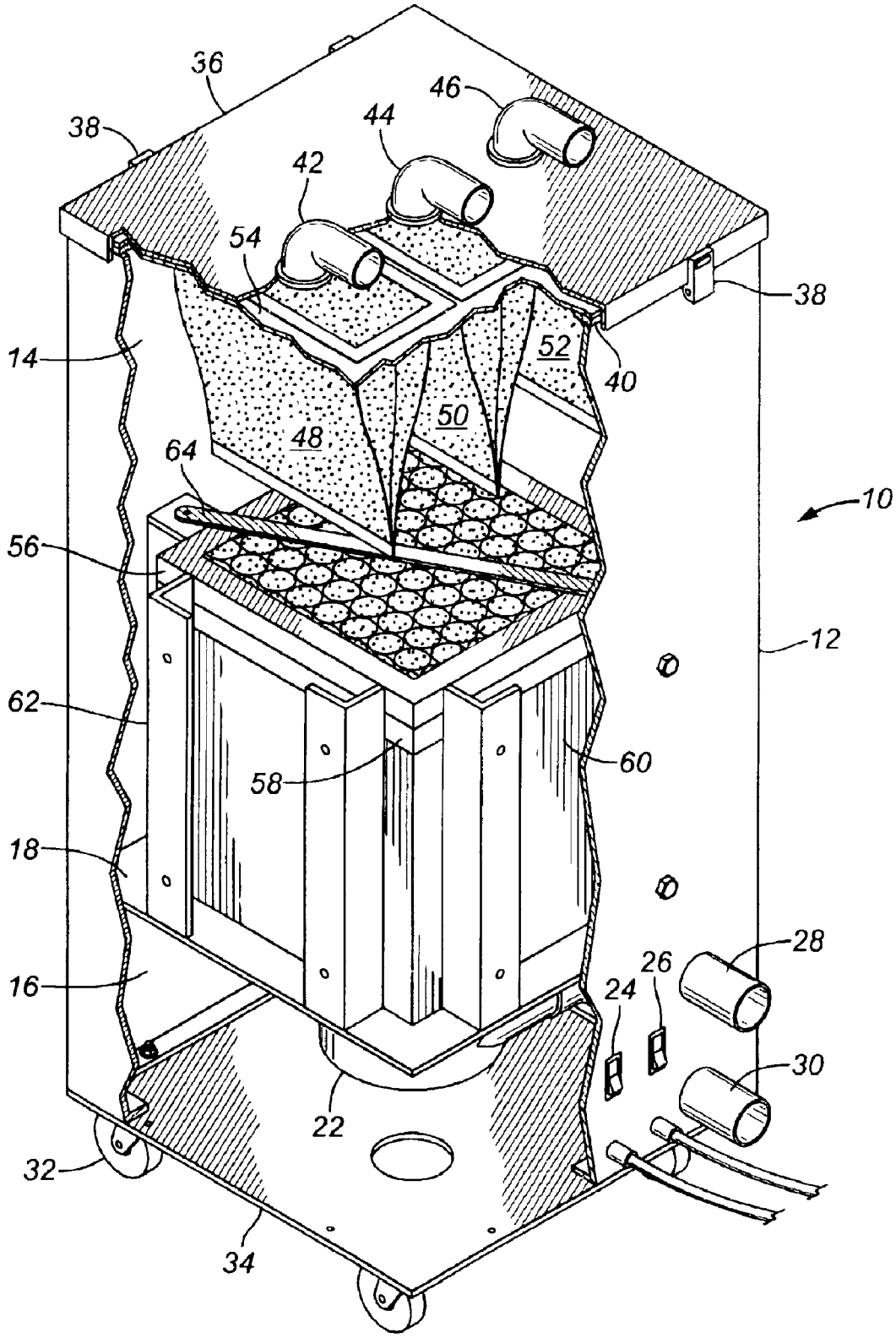
FIG. 1 is an upper corner perspective view, partially in section, of the subject invention.
Figure 2:
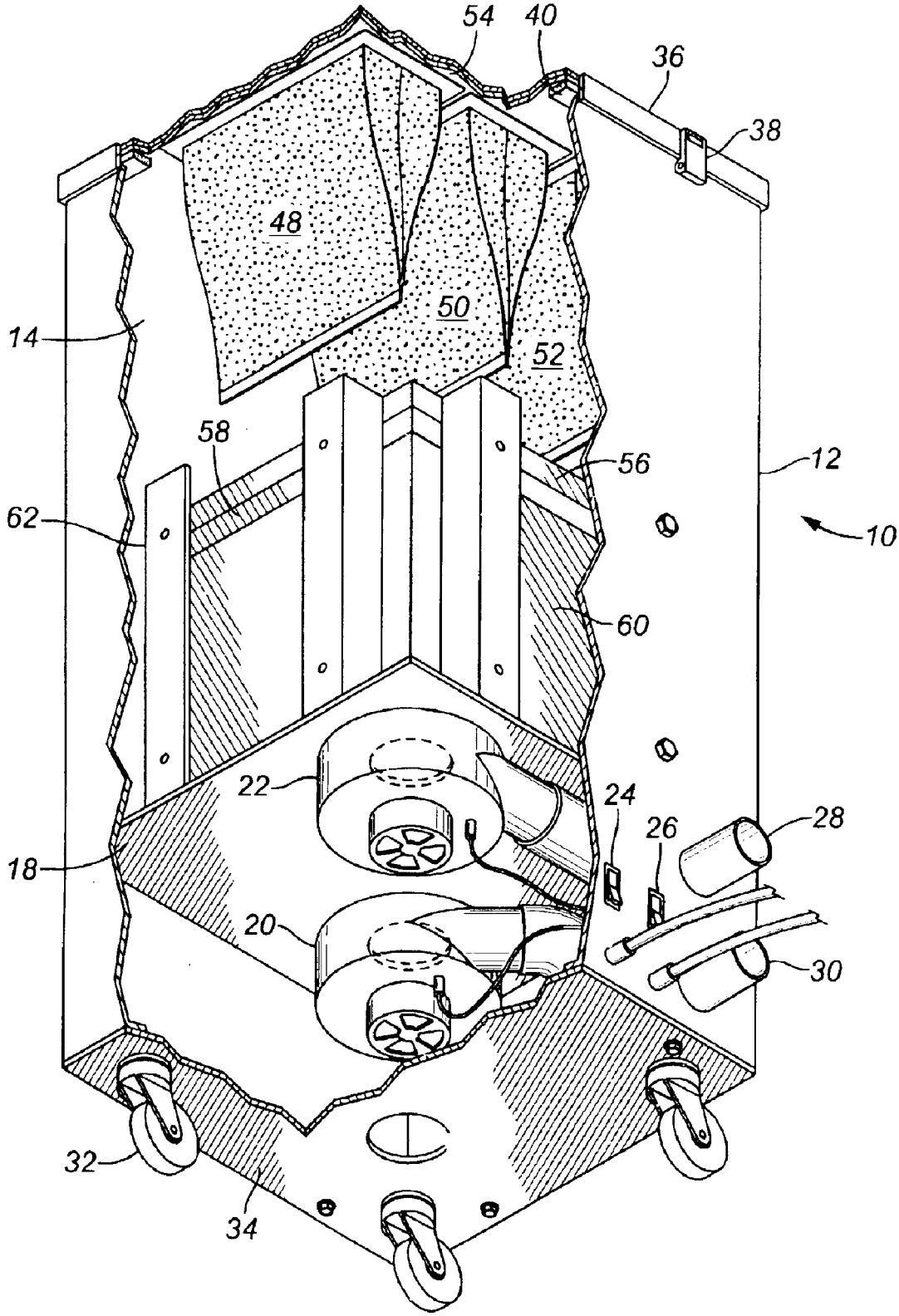
FIG. 2 is a lower corner perspective view, partially in section, of the subject invention.
Figure 3:
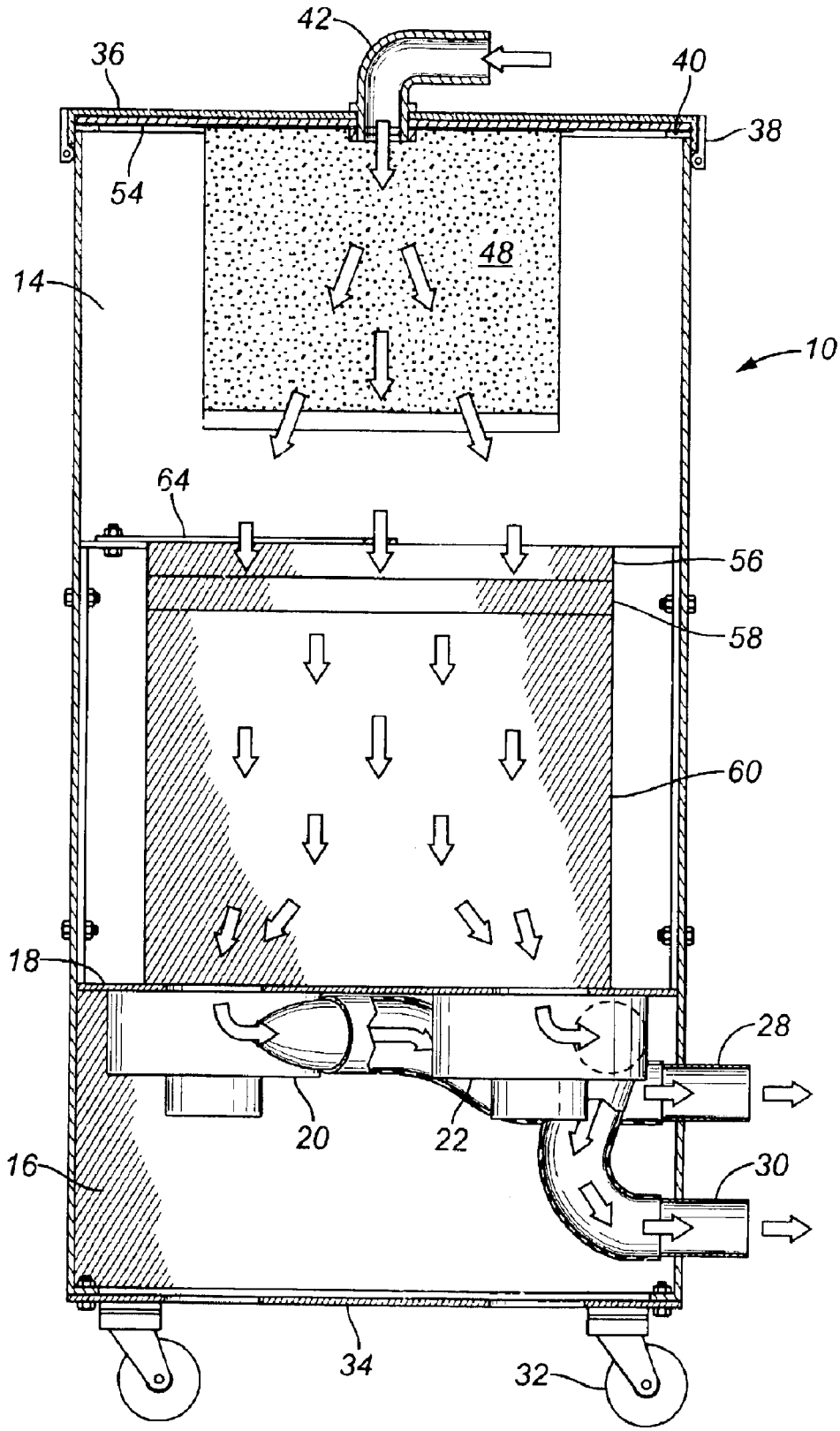
FIG. 3 is a vertical section through the subject invention taken along line 3—3 of FIG. 1.
Figure 4:
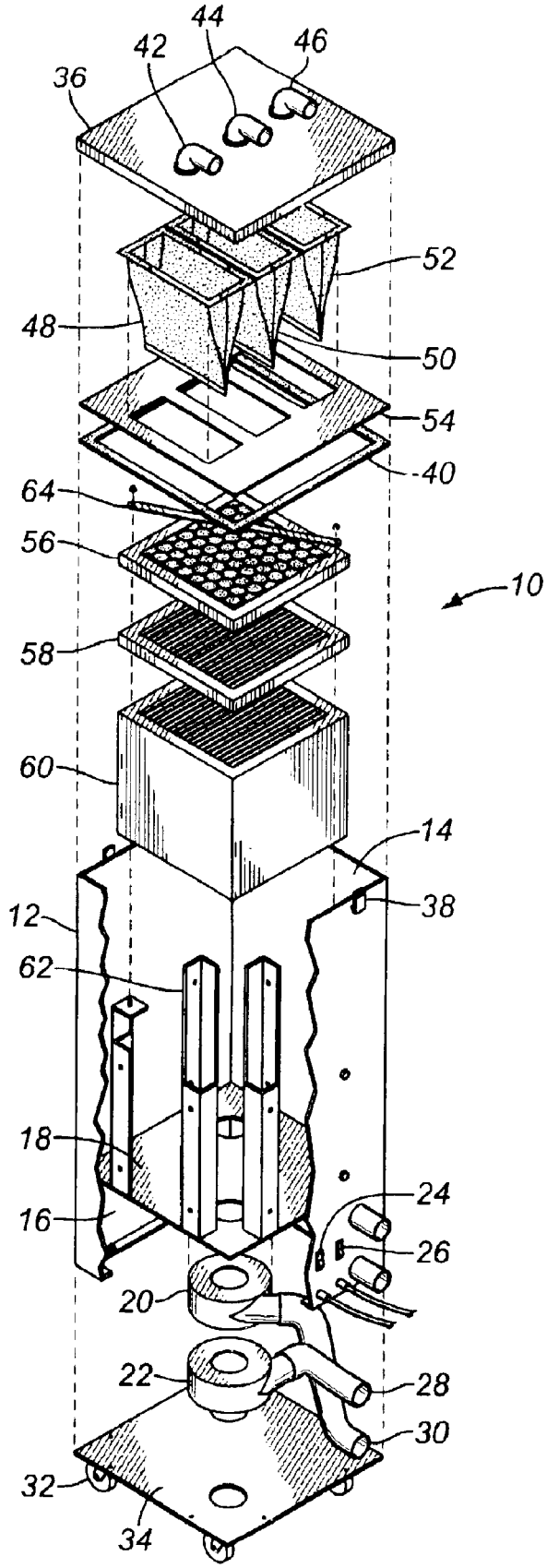
FIG. 4 is an exploded perspective view of the subject invention.

The subject vacuum system 10 has a housing 12, which can have substantially any cross sectional shape, and is divided into upper and lower chambers, 14, 16, respectively, by horizontal plate 18. The bottom chamber 16 contains motor means 20, 22, individual motor control means 24, 26, and exhaust ports 28, 30. Wheels or casters 32 may be attached to a bottom plate 34 enclosing the lower chamber 16 or they can be attached directly to the lower portion of the housing 12. This bottom plate 34 is removably attached to the housing 12 to provide access for servicing of the motor means 20, 22. The upper chamber 14 is enclosed by an upper plate 36 which has means 38 for latchingly securing the upper plate 36 to the housing 12 and annular sealing means 40 providing a vacuum seal between the upper plate 36 and the housing 12. The upper plate 36 is further provided with a plurality of vacuum inlets 42, 44, 46 each of which is designed to receive a hose (not shown) from a vacuum cleaning device (also not shown) and which inlet is sealed closed when not in use. The inner end of each inlet 42, 44, 46 is formed to receive a prefilter bag 48, 50, 52, respectively, the prefilter bags being held in place by an apertured retainer plate 54. A first filter member 56 and a pleated filter member 58 and an HEPA filter module 60, in descending order, are mounted within the chamber 12, positioned by guide brackets 62. The HEPA filter module 60 contains high efficiency particulate air ("HEPA") filters. Such HEPA filters are well known and may be obtained, for example, from Cambridge Filter Corporation. This type of air filter filters out 99.97% of the air borne dust and dirt particles as small as 0.3 microns in size.

The subject invention is readied for cleaning by removing the upper plate 36 and loading sequentially into the upper chamber HEPA filter module 60, pleated filter member 58, and first filter member 56. The assembly of these three filters will be held in place by brackets 62 and may be secured by hold down means 64. Prefilters 48, 50, 52 are positioned with respect to inlet ports 42, 44, 46 and are held in place by retainer plate 54. This top plate assembly is then secured to the housing 12 by latches 38 with annular sealing means 40 providing a vacuum seal between the housing 12 and upper plate 36. The system can now be removed to the cleaning site and the required number of hoses attached thereto by the cleaning technicians. It should again be noted that any inlet that is not used will remain sealed so that there is no loss of vacuum or unwanted ingestion of air.

The air drawn in through the hoses will first pass through the pre filter bags 48, 50, 52 where the larger objects will be removed from the air streams and trapped in the pre filter bags. These pre filter bags, which are inexpensive, should be regularly replaced during the course of a cleaning operation. The prefiltered air next passes through first filter member 56 and pleated filter member 58 before being drawn through the HEPA filter module 60, the vacuum motors 20, 22 and being exhausted through ports 28, 30.

The subject invention is a time saving device in that the setup requirements are minimal and up to three technicians can use the device at the same time. The invention uses inexpensive prefilter bags behind each vacuum port. These bags collect 100% of the larger trash and contaminants thereby prolonging the life of the HEPA filter module. This latter filter assures safety and efficiency in removing contaminants from the work site.

The present invention may be subject to many modifications and changes without departing from the spirit or essential characteristics of the present invention as defined by the appended claims. The present embodiment should therefor be considered in all respects as illustrative and not restrictive of the scope of the invention.

I claim:

1. A highly efficient multi-user, portable vacuuming system comprising:

a housing defining upper and lower vertically spaced chambers separated by a substantially horizontal plate, at least one inlet port opening into said upper chamber and at least one outlet port leading from said lower chamber, and a port in said plate connecting said chambers;

vacuum generating motor means mounted in said lower chamber and connected to said outlet port and said port in said plate filter means in said upper chamber between said at least one inlet port and said port in said plate, said filter means having prefilter means immediately adjacent said at least one inlet port whereby all air ingested by said system first passes through said pre filter means which removes substantially all of the large air borne particles, said pre filter means comprising disposable filter bags each capable of being detachable mounted on a respective inlet port.

2. A vacuuming system according to claim 1 wherein said filter means further comprises:

secondary filter means adjacent said pre filter means whereby all air ingested by said system passes through said secondary filter means to remove smaller air borne particles.

3. A vacuuming system according to claim 2 wherein said secondary filter means comprises:

a pleated filter screen mountable transversely within said upper chamber.

4. A vacuuming system according to claim 2 wherein said filter means further comprises:

HEPA filter means adjacent said secondary filter means whereby air ingested by said system passes through said HEPA filter means removing substantially all of the remaining air borne particles.

5. A vacuuming system according to claim 4 wherein said HEPA filter means is capable of filtering out 99.97% of air borne particles as small as 0.03 microns in size.

6. A vacuuming system according to claim 1 wherein each said inlet port further comprises:

means to seal each respective at least one inlet port when not in use.

7. A method for achieving highly efficient removal of air borne particulate material in a multi-user, portable vacuuming system comprising the steps of:

providing a housing defining upper and lower vertically spaced chambers separated by a substantially horizontal plate, at least one inlet port opening into said upper chamber and at least one outlet port leading from said lower chamber, and a port in said plate connecting said chambers, vacuum generating motor means mounted in said lower chamber and connected to said outlet port and said port in said plate, filter means in said upper chamber between said inlet port and said port in said plate, means to seal each said inlet port when not in use; and sequentially passing the air ingested by said system through pre filter means, to remove the largest particulate material, secondary filter means, to remove further air borne particulate material, and HEPA filter means, whereby substantially all air borne particulate material is removed from the air and entrapped in the filters.

8. A method according to claim 7 wherein said pre filter means comprises:

economical disposable bags immediately adjacent each said at least one inlet port whereby all air ingested by said system first passes through said pre filter means which remove and entrap substantially all of the large air borne particles.

9. A method according to claim 8 wherein said secondary filter means comprises, a pleated screen mounted transversely in said upper chamber.

10. A method according to claim 7 wherein said HEPA filter means removes 99.97% of the air borne particles as small as 0.3 microns in size.

11. A method according to claim 7 wherein each said inlet port is sealed when not in use.

* * * * *